United States Patent [19]

Birke

[11] Patent Number: 4,969,224

[45] Date of Patent: Nov. 13, 1990

[54] SHOE WITHOUT INSOLE

[76] Inventor: Josef C. Birke, Hauptstrasse 55 -57, D-6780 Pirmasens, Fed. Rep. of Germany

[21] Appl. No.: 894,560

[22] Filed: Aug. 8, 1986

[30] Foreign Application Priority Data

Aug. 8, 1985 [DE] Fed. Rep. of Germany ... 8522823[U]

[51] Int. Cl.[5] ..... A43B 9/00; A43B 10/00

[52] U.S. Cl. ..... 12/142 F; 12/142 RS; 36/106

[58] Field of Search ..... 12/142 T, 142 F, 142 RS, 12/145; 36/106, 12, 19.5, 17 PW, 28

[56] References Cited

U.S. PATENT DOCUMENTS

| | | | |
|---|---|---|---|
| 371,713 | 10/1887 | Smith | 12/142 F |
| 1,976,135 | 10/1934 | Murray | 12/142 F |
| 2,317,880 | 4/1943 | Bingham, Jr. | 36/4 |
| 3,007,209 | 11/1961 | Roberts | 12/142 RS |
| 3,757,436 | 9/1973 | Winkler et al. | 36/46.5 |
| 3,913,160 | 10/1975 | Funck | 12/142 R |
| 4,399,620 | 8/1983 | Funck | 36/28 |
| 4,519,147 | 5/1985 | Jones, Jr. | 36/19.5 |
| 4,597,125 | 7/1986 | Jones, Jr. | 12/142 F |

FOREIGN PATENT DOCUMENTS

| | | | |
|---|---|---|---|
| 443895 | 5/1927 | Fed. Rep. of Germany | 12/142 F |
| 1142040 | 9/1957 | France | 12/142 F |
| 969241 | 11/1982 | U.S.S.R. | 12/142 F |
| 465037 | 4/1937 | United Kingdom | 12/142 F |
| 543053 | 2/1942 | United Kingdom | 12/142 RS |

*Primary Examiner*—Steven N. Meyers

*Attorney, Agent, or Firm*—Toren, McGeady & Associates

[57] ABSTRACT

In order to produce a shoe without insole, the lasting fold of a shoe upper (4) is glued directly on the underside of a last (1), specifically with the use of an adhesive which is selectably releasable at some later time. Next, an outside sole (5), which is provided with an adhesive layer (6) in the area of the lasting fold and possibly in the area of the side leather, is glued to the shoe upper (4). Next, the adhesive power of the selectably releasable adhesive is cancelled, for example, by means of heating, and the adhesive power of the adhesive (6) between the shoe upper (4) and the outside sole (5) is increased. Now the last (1) can be removed from the completed shoe. Such a shoe without insole is particuarly suited as an orthopedic shoe which makes possible a direct contact between the foot and the soft upperside of the outside sole (5).

6 Claims, 2 Drawing Sheets

SHOE WITHOUT INSOLE

BACKGROUND OF THE INVENTION

1. Field of the Invention

The invention is directed to a shoe without an insole, which is produced in the adhesive lasting process, as well as to a method for its production.

2. Description of the Prior Art

Such a shoe is known from the DE-Pat. No. 32 01 488 of the inventor. In the production of this shoe, an insole is used which is coated on the underside with material which can be split or broken up, preferably manila paper. The proven adhesive lasting process can be preserved by means of using such a special insole. As soon as the middle (intermediate) sole and/or the outside sole is glued on, the insole can be taken out of the shoe by splitting the manila paper. Only a layer of the split paper remains in the shoe.

This known shoe can be produced in the adhesive lasting process, which has been known for a long time and according to which approximately 70 to 80% of all shoes are still produced today, this being the only possible method for producing orthopedic shoes individually, in particular. Lacking insoles, the shoe is lighter, lower, softer and more resilient and offers the possibility of providing desired cushions, foot beds (supports), inners soles, etc. The direct contact between the soft sole or middle sole material and the foot, which contact is achieved in footwear without insoles, provides a substantially more resilient and, therefore, more trouble-free comfortable step and, accordingly, also a more resilient step development than is possible with the previously known footwear equipped with insoles. Even when inserts and the like are used, the shoe does not differ in appearance from a conventional shoe.

It also has already been attempted to produce shoes without soles by means of directly spraying a plastic sole on the upper leather. However, special plastics spraying machines with a spraying last for each shoe are required for this purpose. Both are very expensive and are profitable only in large-scale production. Moreover, the upper leather usually is in a very simple, inelegant form. On the other hand, the production of orthopedic footwear in particular, may only be performed individually, or at best, on a small-scale production, wherein the individual shape of the feet, which are usually malformed, must be taken into account.

It is also known to produce shoes without insoles by applying the so-called lace lasting process (U.S. Pat. Nos. 3,570,151 and 3,913,160). The lace lasting process is considerably more costly than the adhesive lasting process and is therefore uneconomical. The lasting lace can also be disturbing, particularly for sensitive feet. This process was therefore unsuccessful.

SUMMARY OF THE INVENTION

It is an object of the present invention to provide a shoe without an insole, particularly an orthopedic shoe, which is producible in the adhesive lasting process and in whose production one can not only dispense with an insole coated with material which can be split, but the use of an insole in its entirety can also be dispensed with.

This object is met in that an adhesive layer is provided on the side of the lasting fold remote of the outside sole, which adhesive layer is selectably releasable after a middle or outside sole is glued on.

By means of an adhesive layer which is selectably releasable and which is preferably constructed only as a welt (border) strip, it is possible to fasten the lasting fold of the shoe upper onto a normal insole, which is temporarily attached in the usual manner on the underside of the last, or to fasten the lasting fold directly on the last. The further production of the shoe is effected entirely in the conventional manner by gluing a middle sole or outside sole on the open side of the lasting fold and/or the lower lateral border of the shoe upper. One need only see to it that the adhesives used for gluing the middle or outside sole will not loosen under the conditions under which the selectably releasable adhesive layer releases. Adhesives which temporarily or completely lose their adhesive power, for example, when heated or with the application of moisture or some other solvent, are suitable for the selectably releasable adhesive layer. Adhesives which automatically lose their adhesive power after a certain period of time are also usable.

In order to take advantage of the walking comfort which is attainable by means of dispensing with the conventional insole, in an optimal manner, the lasting fold is ground so as to taper in a thinning manner toward the middle of the sole.

According to an advantageous development of the invention, the side of the outside sole facing the foot is resilient and soft. The walking side of the outside sole can be designed to have optimal stability of shape and scuff or abrasion resistance.

In shoes with rigid support in the shank area, a half insole of the conventional type can be incorporated. The advantages attainable according to the invention are nevertheless preserved in the area of the front part of the foot. Such shoes are particularly suitable as orthopedic shoes.

The subject matter of the present invention is, in addition, a method for producing a shoe without an insole in the adhesive lasting process.

According to a first variation, the lasting fold of the shoe upper is attached to an insole, which is fastened in the usual manner on the underside of a last, by means of an adhesive which is selectably releasable. Next, the outside sole is fastened onto the shoe upper. As soon as this happens, the adhesive power of the selectably releasable adhesive is cancelled and the last and insole are removed from the shoe.

According to a second variation, the lasting fold of the shoe upper is mounted directly onto the underside of the last by an adhesive which is selectably releasable. After fastening the outside sole onto the shoe upper, the adhesive force of the selectably releasable adhesive is cancelled and the last is removed from the shoe.

Thus, the second variation has the advantage that an insole is no longer needed during the entire shoe production. Instead, the shoe upper is glued directly to the underside of the last, which is unthinkable in the previous method.

According to a preferred development of the method, according to the invention, the adhesives are heated, wherein the selectably releasable adhesive between the lasting fold and last (or insoles) loses its adhesive power and the adhesive between the shoe upper and the outside sole increases its adhesive power.

Seen as a whole, the invention results in an economizing of the insole with the reduction of volume and weight and the increase flexibility following from this, as well as in a direct foot contact with predetermined materials which are soft and reduce perspiration, promoting the well-being of the foot and preventing foot pain.

The invention is explained in more detail in the form of an embodiment example with the aid of the drawings.

DESCRIPTION OF THE PREFERRED EMBODIMENT

Figure 1:
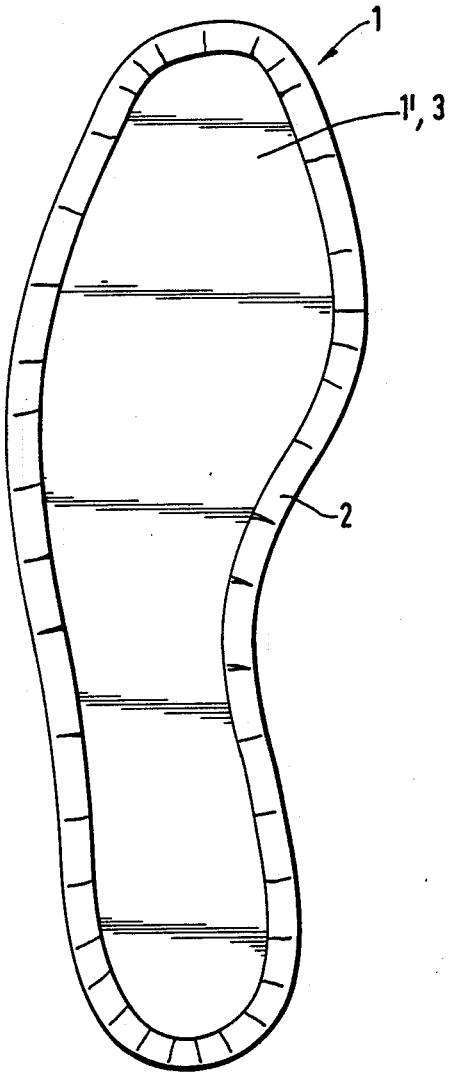
FIG. 1 shows a plan view of the underside of a mounting (assembling) last.
Figure 2:
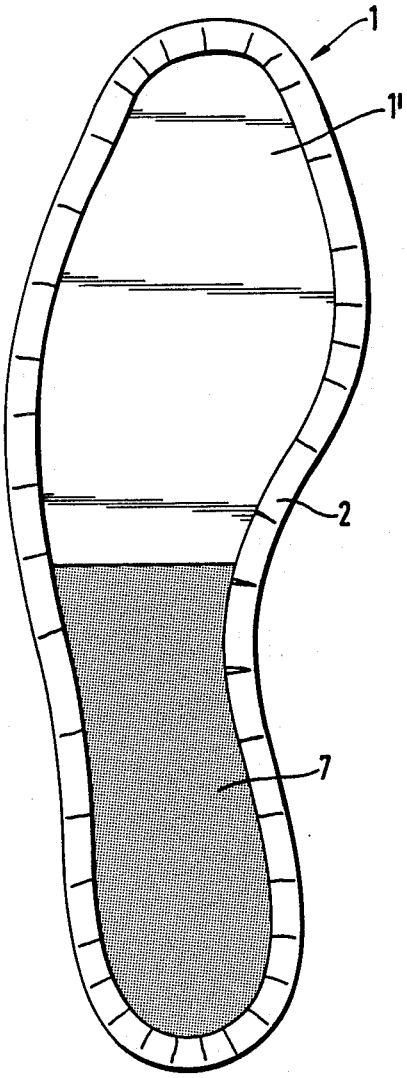
FIG. 2 shows a plan view, according to FIG. 1, with the use of a partial insole.

In FIGS. 1 and 2, the underside of a mounting last 1 is designated by reference number 1'. For the production of the shoe, it is possible to fasten a conventional insole 3 on the underside of the last 1. A gluing border on the underside 1' of the last 1 or of the insole 3, which is fastened thereto, serves to temporarily fasten the lasting fold 2 of the shoe upper 4. A portion 2' of the lasting fold 2 is ground so as to taper in a thinning manner toward the middle of the sole. The lasting fold 2 may be tapered, as demonstrated by numeral 2', in a thiming manner toward the middle of the underside 1 of the last 1.

Thus, the production of the shoe is effected in the conventional adhesive lasting process, wherein the lasting fold 2 is mounted either directly to the last 1 or to the insole 3, which is temporarily attached thereto, with the aid of an adhesive which can be selectably released. The adhesive lasting can be effected manually or mechanically. Practically any commercially available insole can be used as insole 3.

Any adhesives whose adhesive power can be selectably cancelled after the production of the shoe can be used for fastening the lasting fold. Adhesives are known which lose their adhesive strength when heated. For the other gluing, specifically for connecting the upper 4 and the outside sole 5, adhesives are used which do not lose their adhesive power under these conditions, but which improve it, is possible. Adhesives are known which harden at increased temperatures.

In shoes with rigid shanks which remain in the shoes, primarily shoes with high heels, a partial insole 7 is used in the heel and shank area. The front part of the foot and the toes maintain direct contact with the soft upperside of the outside soles in these shoes, also.

Figure 3:
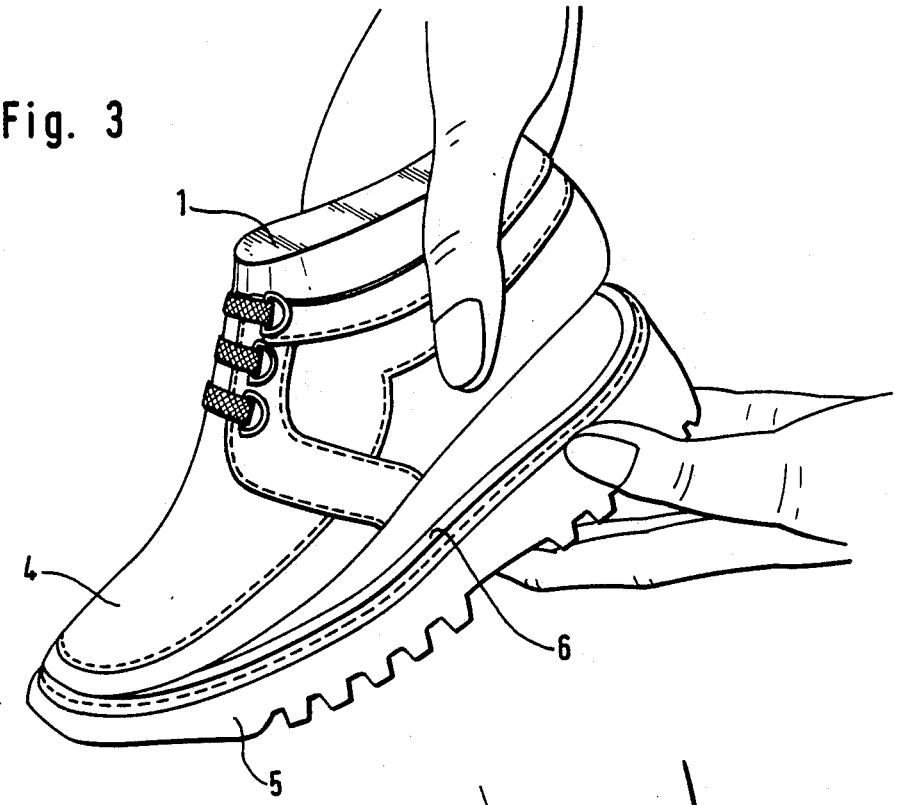
FIG. 3 shows the fastening of an adhesive-last upper onto the outside sole.

FIG. 3 shows the fastening of the shoe upper 4, which is still fastened to the last 1, but which is otherwise completed, on an outside sole 5. Any desired sole can be used, in principle, as the outside sole 5. Naturally, soles are preferred whose upperside, which contacts the foot, is soft and resilient in order to offer the foot, correspondingly, walking comfort. The connection between the upper 4 and the outside sole 5 is likewise effected in the area of a welt strip 6 of the width of the lasting fold 2, the welt strip 6 being coated with adhesive. If a shell sole is used as the outside sole 5, its border is also glued with the side leather of the shoe upper 4, and possibly sewn.

As soon as the connection between the upper 4 and the outside sole 5 is produced, the last 1 can be removed from the shoe. For this purpose, the adhesive power of the selectably releasable adhesive layer is cancelled by means of appropriate measures, for example, by means of heating the last 1. In so doing, the other adhesive on the welt strip 6 can harden.

Figure 4:
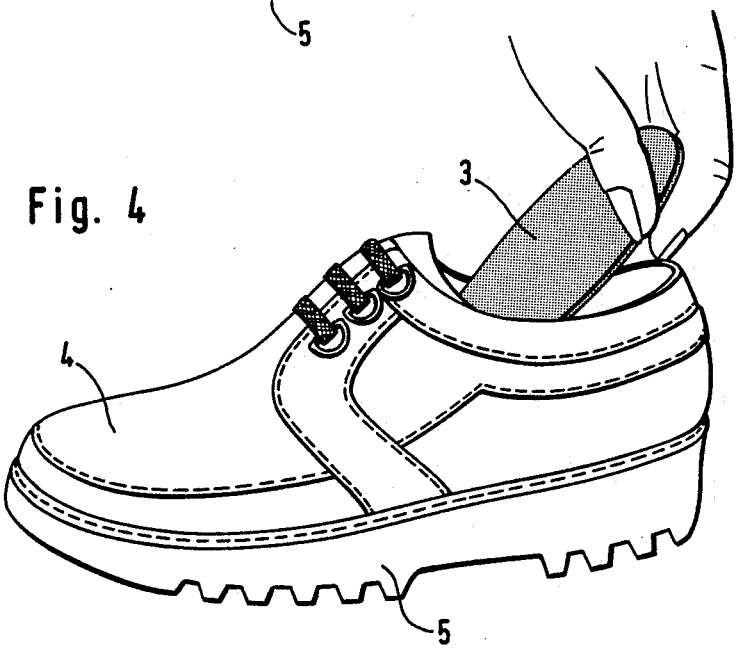
FIG. 4 shows the removal of the insole or the last from the finished shoe after loosening the adhesive between the lasting fold and last or insole.

In the event an insole 3 was provided, the adhesive power of the selectably releasable adhesive layer can be cancelled by means of suitable measures, for example, by means of heating or applying solvent, and the insole 3 itself can be removed from the shoe. This process is shown in FIG. 4.

Thus, the finished shoe has no insole. It is light and flexible and makes possible a direct contact between the sole of the foot and the upperside of the outside sole 5. The outside sole 5 can be equipped with special cushions, foot supports, etc. before gluing, if necessary, particularly for orthopedic uses.

Shoes with a rigid support in the shank, in which half insoles 7 are incorporated, which latter leave open the area at the front part of the foot, can also be produced without changing the production method.

Numerous alterations of the structure herein disclosed will suggest themselves to those skilled in the art. However, it is to be understood that the embodiment disclosed herein are for purposes of illustration only and are not to be construed as a limitation of the invention. All such modifications which do not depart from the spirit of the invention are intended to be included within the scope of the appended claims.

What is claimed is:

1. A method for producing a shoe without insole according to an adhesive lasting process, said shoe including a shoe upper having a lasting fold, and a middle or an outside sole, wherein said method comprises:

fastening a temporary insole on an underside of a last in accordance with the adhesive lasting process;

mounting a side of said lasting fold of said shoe upper remote from said middle or outside sole to said insole, fastened to said last, using an adhesive layer which is selectably releasable;

fastening said middle or outside sole to said lasting fold and/or said shoe upper; and removing said temporary insole, after having removed said last, by releasing said adhesive layer.

2. A method according to claim 1, characterized in that said lasting fold is ground so as to taper in a thinning manner toward the middle of the sole before the fastening of said middle or outside sole.

3. A method according to claim 1, characterized in that said adhesive layer is selectably releasable by heating.

4. A method according to claim 1, characterized in that said middle or outside sole is fastened to said lasting fold and/or said shoe upper by a further adhesive, the strength of which increases upon application of heat.

5. A method for producing a shoe without insole according to an adhesive lasting process, said shoe including a shoe upper having a lasting fold, and a middle or outside sole, wherein said method comprises:

mounting a side of said lasting fold of said shoe upper remote from said outside sole to an underside of a last using an adhesive layer which is selectably releasable by heat;

fastening said middle or outside sole to said lasting fold and/or said shoe upper; and removing said last by releasing said selectably releasable adhesive layer.

6. A method for producing a shoe without insole according to an adhesive lasting process, said shoe including a shoe upper having a lasting fold, and a middle or outside sole, wherein said method comprises:

mounting a side of said lasting fold of said shoe upper remote from said outside sole to an underside of a last using an adhesive layer which is selectably releasable;

fastening said middle or outside sole to said lasting fold and/or said shoe upper by a further adhesive, the strength of which increases upon application of heat; and removing said last by releasing said selectably releasable adhesive layer.

* * * * *